US010786092B1

(12) United States Patent
Yan

(10) Patent No.: US 10,786,092 B1
(45) Date of Patent: Sep. 29, 2020

(54) FOLDABLE BABY CARRIER

(71) Applicant: Chengxiao Yan, Fujian (CN)

(72) Inventor: Chengxiao Yan, Fujian (CN)

( * ) Notice: Subject to any disclaimer, the term of this patent is extended or adjusted under 35 U.S.C. 154(b) by 16 days.

(21) Appl. No.: 16/412,370

(22) Filed: May 14, 2019

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025
USPC ..... 224/159–161, 270
See application file for complete search history.

(56) References Cited

U.S. PATENT DOCUMENTS 5,222,641 A * 6/1993 Medeiros, Jr. ..... A47D 13/025 224/161
5,381,941 A * 1/1995 Brune ..... A45F 3/26 224/153
5,496,092 A * 3/1996 Williams ..... A61F 5/3792 297/250.1
5,509,590 A * 4/1996 Medeiros, Jr. ..... A47D 13/025 224/161
5,527,089 A * 6/1996 Charest ..... A45F 4/02 224/155
5,662,339 A * 9/1997 Svendsen ..... A47D 13/025 224/153
6,662,981 B2 * 12/2003 McUmber ..... A45F 3/10 224/155
9,307,846 B1 * 4/2016 Jones ..... A47D 13/025
9,314,113 B1 * 4/2016 Lehan ..... A47D 13/025
2008/0047987 A1 * 2/2008 Price ..... A47D 13/025 224/159
2010/0133303 A1 * 6/2010 Schilly ..... A45F 3/047 224/155
2016/0286980 A1 * 10/2016 Telford ..... A47D 15/006
2018/0084923 A1 * 3/2018 Kang ..... A47D 13/025

FOREIGN PATENT DOCUMENTS

CN 208017261 10/2018

* cited by examiner

*Primary Examiner* — Corey N Skurdal
(74) *Attorney, Agent, or Firm* — JCIPPRNET

(57) ABSTRACT

A foldable baby carrier includes a seat cushion connected to the carrier body. The seat cushion includes a hipseat detachably mounted on the carrier body and a cover sleeved on the hipseat. The hipseat includes a support portion and a bearing portion, and the support portion and the bearing portion are rotatably connected to form a foldable body through two switch buttons disposed on two sides of the support portion. A support connection base is fixed on the support portion, a bearing connection base is fixed on the bearing portion. The spring abuts against a switch control lock and the bearing connection base. When a position-limiting block provided on an outer wall of the switch control lock is in an open position-limiting recess, the position-limiting block is stuck by the open position-limiting recess and in an open state. When the position-limiting block is in a folded position-limiting recess, an inclined surface on the position-limiting block and an inclined surface on the folded position-limiting recess are attached together to become a closed state.

4 Claims, 7 Drawing Sheets

FOLDABLE BABY CARRIER

BACKGROUND OF THE DISCLOSURE

Field of the Disclosure

The disclosure relates to a baby carrier, and more specifically to a foldable baby hipseat carrier.

Description of Related Art

At present, the use of baby carriers enables more parents to free their hands from holding their baby, which not only helps them to save energy but also allows the baby to have more physical contact with parents, and also brings sense of security to the baby. Also, the baby is under the parents' observation at any time so the parents can be at ease. At present, a baby hipseat carrier suitable for 6-month-old or older infants is more and more popular. As shown in FIG. 1 and FIG. 2, a conventional baby hipseat carrier includes a seat cushion 2 connected under a back cushion 1. The seat cushion 2 is constructed directly from a piece of seat cushion 21. The seat cushion 21 is wrapped in a body of the baby carrier, which realizes the function of seat cushion but occupies the space, and not only the size is too large to be carried but also the overall baby carrier looks clumsy.

In order to solve the above issue, a foldable baby carrier is created. The seat cushion of such carrier includes a hipseat sleeved in a cover. The hipseat includes a support portion and a bearing portion. The support portion and the bearing portion are rotatably connected into a foldable body through a switch button. The foldable body can be closed by folding or opened to become a seat cushion.

However, the foldable body with the structure of known foldable baby carrier can only be operated by being unlocked through pushing the switch button no matter in the state of closed from an open state or in the state of opening from a closed state. In that case, the operation causes a lot of trouble. When adults are with infants, it would be ideal that the foldable body can be opened quickly because it is difficult to perform additional operation.

SUMMARY OF THE DISCLOSURE

The disclosure provides a foldable baby carrier with the purpose to solve the shortcomings of known technology, so that user can conveniently perform the operation of folding hipseat and the safety performance is good.

The technical solution adopted by the disclosure to solve the technical problem is:

A foldable baby carrier includes a seat cushion connected to a carrier body. The seat cushion includes a hipseat detachably disposed on the carrier body and a cover sleeved on the hipseat. The hipseat includes a support portion and a bearing portion. The support portion and the bearing portion are rotatably connected and formed into a foldable body through a left switch button and a right switch button disposed on two sides of the support portion. A support connection base is fixed on the support portion. A bearing connection base is fixed on the bearing portion.

The switch button includes a connection shaft. The connection shaft sequentially passes through the support connection base, a switch control lock and a spring and then fixed on the bearing connection base.

The spring abuts against the switch control lock and the bearing connection base.

The switch button further includes a button member which is movably engaged with the support connection base. The button member is pressed on the surface of the switch control lock.

A position-limiting block is provided on an outer wall of the switch control lock. An inner wall of the support connection base is provided with a first positioning-limiting recess and a second position-limiting recess for each of the position-limiting block.

When the position-limiting block is in the second position-limiting recess, the position-limiting block is stuck by the second position-limiting recess; the support portion and the bearing portion are in an open state.

The position-limiting block has a first inclined surface, and the first inclined surface faces the bearing connection base. A wall of the first position-limiting recess has a second inclined surface, and the second inclined surface faces the switch control lock. When the position-limiting block is in the first position-limiting recess, the first inclined surface on the position-limiting block and the second inclined surface on the first position-limiting recess are attached together, and the support portion and the bearing portion are in a closed state.

A plurality of engaging slots are provided on an outer wall of the switch control lock. Correspondingly, a plurality of engaging blocks are provided in the bearing connection base. The engaging blocks are inserted into the engaging slots, such that the switch control lock can be elastically moved horizontally and inserted on the bearing connection base.

At least one end portion of the cover adopts a velcro tape or zipper for connection, and the other end portion is a sleeve with one end being open. The two end portions are respectively sleeved on the support portion and the bearing portion of the hipseat.

The two end portions are connected through an elastic material such as a fastener.

The advantage of the disclosure lies in:

The disclosure has a hipseat that is foldable and flexible. When in use, the hipseat can be closed by gently pressing the button member. If the button is not pressed, the hipseat will be locked and cannot be closed by itself, which ensures safety. There is no need to press the button to open the hipseat, the hipseat can be opened by directly pulling to open the support portion and the bearing portion of the hipseat, so the operation is convenient. The secured and locked support portion and the bearing portion are provided with a malleable cover to form a comfortable hipseat to carry the baby for the baby to enjoy being in the adult's arm. The disclosure significantly reduces the room for accommodation when not in use, makes it convenient for carry and brings a lot of convenience for the user.

BRIEF DESCRIPTION OF THE DRAWINGS

The disclosure is further described with reference to drawings and embodiments below.

DESCRIPTION OF EMBODIMENTS

Figure 1:
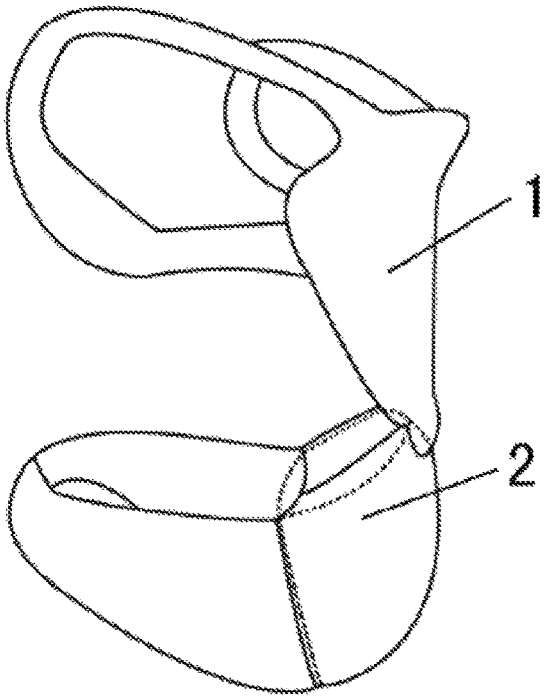
FIG. 1 is a schematic perspective view of the structure a baby carrier in known technology.
Figure 2:
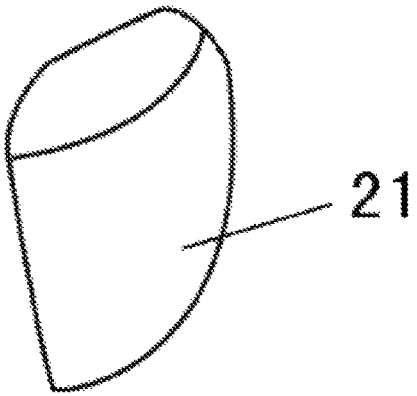
FIG. 2 is a schematic perspective view of the structure a hipseat in known technology.
Figure 3:
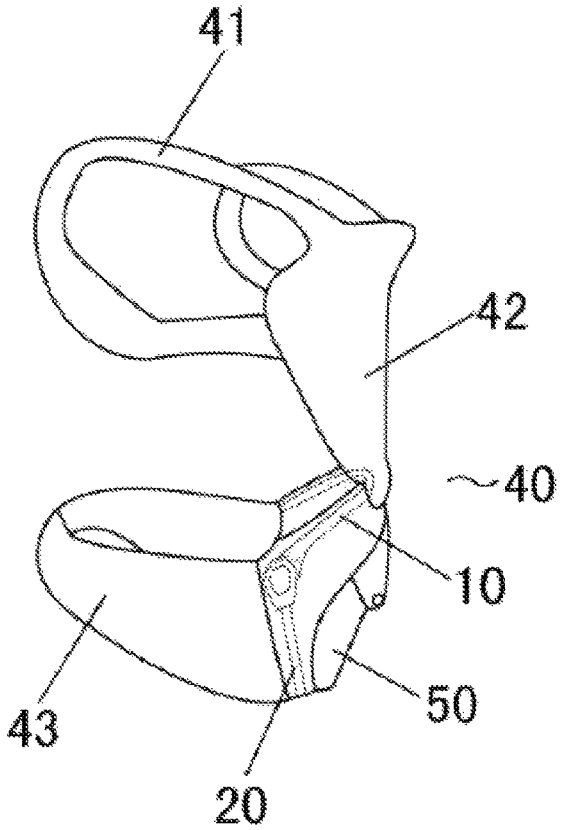
FIG. 3 is a schematic perspective view of the structure a carrier in the disclosure.

In order to more clearly illustrate the technical solutions of the present disclosure, the drawings used in the description will be briefly described below. It is obvious that the drawings in the following description are only some embodiments of the present disclosure. Other embodiments may be derived by those skilled in the art according to the drawings without making inventive effort.

As shown in FIG. 3, FIG. 4, FIG. 5, FIG. 6, FIG. 7, FIG. 8, FIG. 9 and FIG. 10:

A foldable baby carrier, including a barrier body 40 provided with a back cushion 42 connected to a shoulder strap 41 and a seat cushion 50 connected to a belt 43, and the seat cushion 50 is connected under the back cushion 42.

The seat cushion 50 includes a hipseat detachably disposed on the carrier body 40. The hipseat includes a support portion 10 and a bearing portion 20. The support portion 10 and the bearing portion 20 are rotatably connected and formed into a foldable body through a switch button 30. The foldable body is sleeved in a cover 52 to form the seat cushion 50 disposed on the carrier body 40.

The hipseat includes the support portion 10 and the bearing portion 20. The support portion 10 and the bearing portion 20 are rotatably connected through the switch button 30.

The support portion 10 and the bearing portion 20 are in a hollow open ring shape to sufficiently reduce the weight and size of the hipseat.

An end portion of the support portion 10 is fixed to a support connection base 33, and an end portion of the bearing portion 20 is fixed to a bearing connection base 36.

A left switch button 30A and a right switch button 30B are respectively provided on two sides of the support portion 10. It is required to simultaneously press the left switch button 30A and the right switch button 30B to operate. If only one of the left switch button 30A and the right switch button 30B is pressed, the other one would still be locked and the operation would be failed.

The switch button 30 includes a connection shaft 34. The connection shaft 34 is a pin. The pin sequentially passes through the support connection base 33, a switch control lock 32 and a spring 31, and the bearing connection base 36.

In other embodiments, it may be that the pin sequentially passes through the bearing connection base, the switch control lock and the spring, and then screwed and fixed on the support connection base.

The spring 31 is sleeved on the connection shaft 34 and abuts against the switch control lock 32 and the bearing connection base 36.

The bearing connection base 36 may be rotated about the connection shaft 34.

A plurality of engaging slots 323 are provided on the outer wall of the switch control lock 32. Correspondingly, a plurality of engaging blocks 363 are provided in the bearing connection base 36. The engaging blocks 363 are inserted into the engaging slots 323, such that the switch control lock 32 can be elastically moved in the movement direction of the spring 31 and inserted on the bearing connection base 36.

The switch button 30 further includes a switch member 35. The switch member 35 has four legs 351. The four legs 351 are movably sleeved through the support connection base 33. A hook portion 352 protruded at the terminal end of the leg 351 is engaged with the support connection base 33 to ensure that the button member 35 does not fall out of the support connection base 33.

The button member 35 passes through the support connection base 33 and then presses on the upper surface of the switch control lock 32. When the button member 35 is pressed, the switch control lock 32 moves toward the direction of the bearing connection base 36, then the spring 31 is compressed; when the button member 35 is released, the spring 31 drives the switch control lock 32 to reset.

A position-limiting block 321 is provided on the outer wall of the switch control lock 32. The inner wall of the support connection base 33 is provided with two position-limiting recesses, which are a first position-limiting recess and a second position-limiting recess respectively, corresponding to each of the position-limiting block 321.

Figure 6:
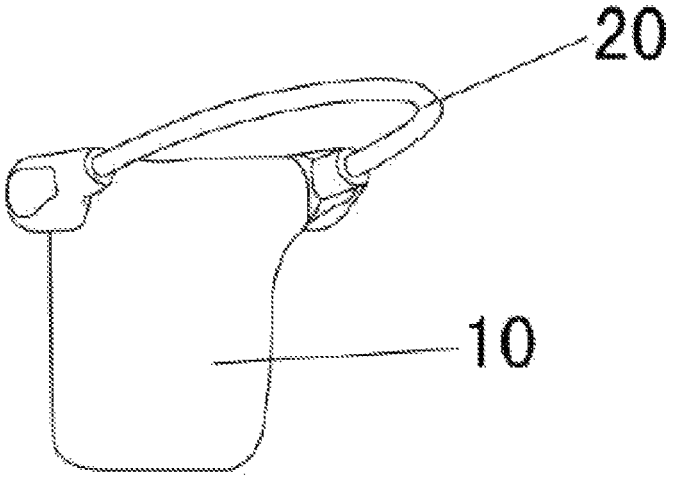
FIG. 6 is a schematic perspective structural view showing an open state of the hipseat in the disclosure.
Figure 7:
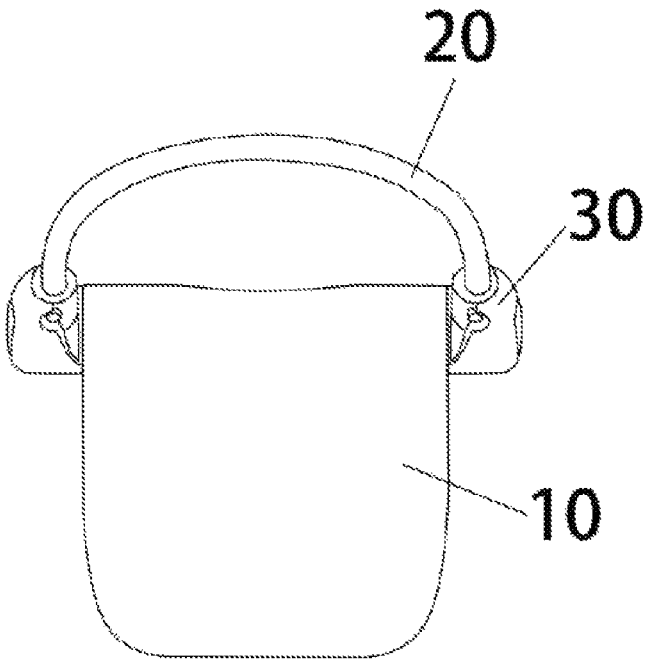
FIG. 7 is a schematic main structural view showing an open state of the hipseat in the disclosure.
Figure 8:
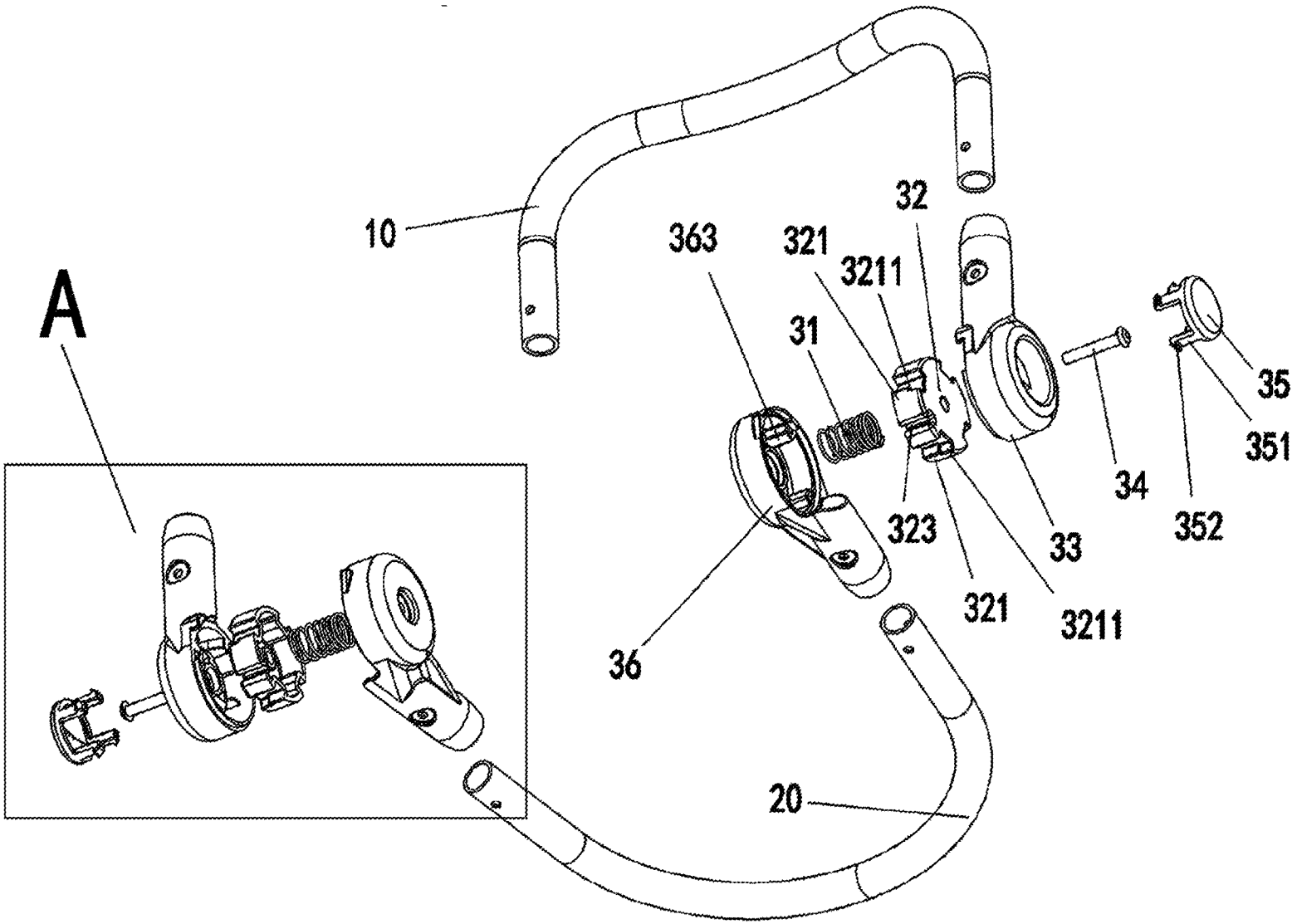
FIG. 8 is a perspective explosive view of the disclosure.
Figure 9:
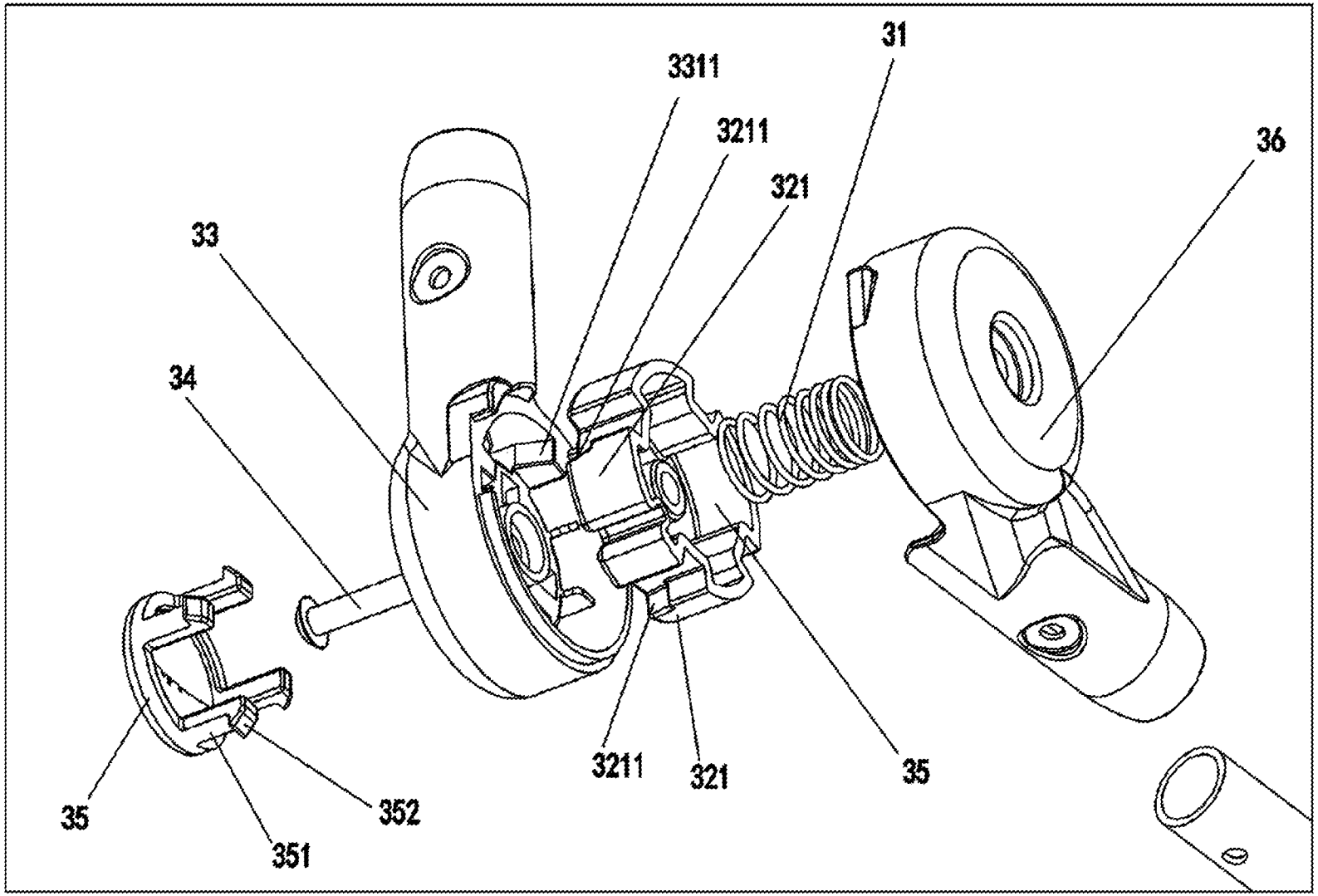
FIG. 9 is an enlargement view of portion A in FIG. 8.
Figure 10:
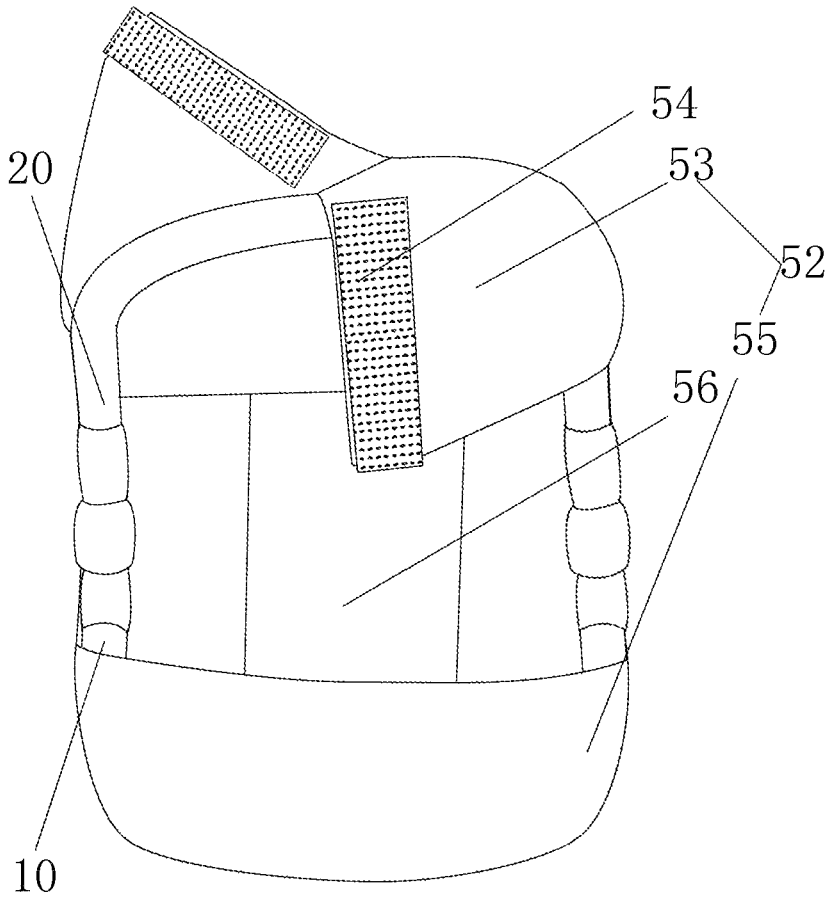
FIG. 10 is a schematic view of covering the hipseat by a cover.

When the position-limiting block 321 is in the second position-limiting recess, the position-limiting block 321 is stuck by the second position-limiting recess. The support portion 10 and the bearing portion 20 are in an open state with a certain angle as shown in FIG. 6 and FIG. 7, and the support connection base 33 and the bearing connection base 36 cannot rotate relative to each other.

When the button member 35 is pressed, the switch control lock 32 will move toward the direction of the bearing connection base 36. The position-limiting block 321 is detached from the second position-limiting recess, and the user can grab the support portion 10 and the bearing portion 20 to rotate relative to each other. When the position-limiting block 321 is rotated to the position of the first position-limiting recess, the spring 31 is restored and pushes the position-limiting block 321 into the first position-limiting recess. The support portion 10 and the bearing portion 20 are in the closed state.

It requires the user to simultaneously press the button members 35 of the left switch button 30A and the right switch button 30B to change the support portion 10 and the bearing portion 20 from the open state into the closed state, which can prevent the weight of the baby or external force from accidentally causing the support portion 10 and the bearing portion 20 to be closed and resulting in danger.

Figure 4:
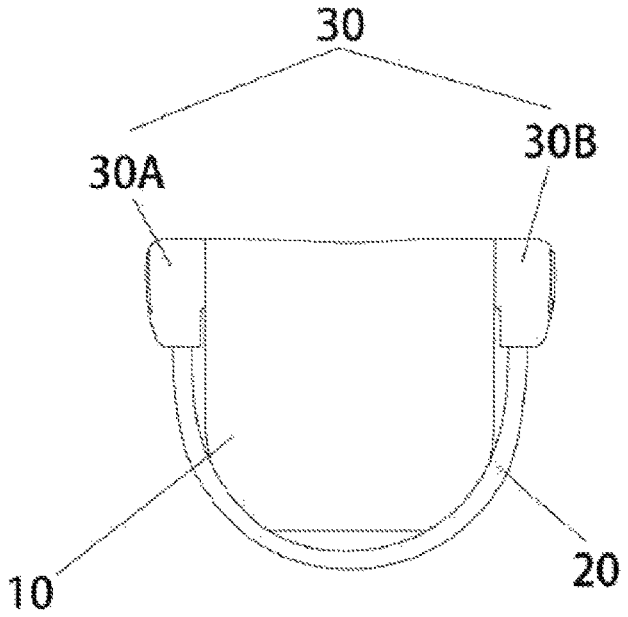
FIG. 4 is a schematic main structural view showing a closed state of the hipseat in the disclosure.
Figure 5:
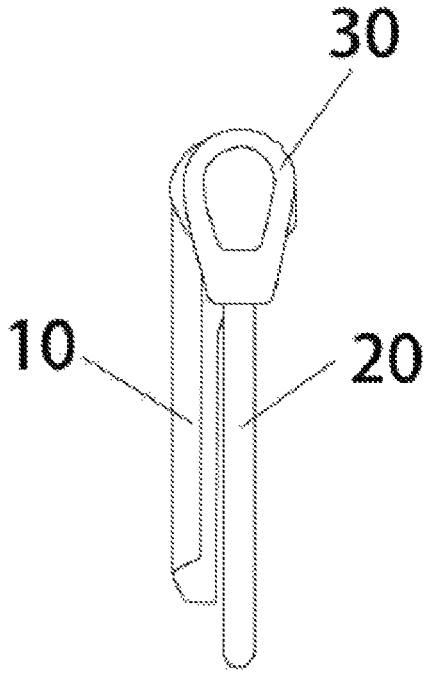
FIG. 5 is a schematic side structural view showing a closed state of the hipseat in the disclosure.

The position-limiting block 321 has a first inclined surface 3211, and the first inclined surface 3211 faces the bearing connection base 36. The wall of the first position-limiting recess is provided with a second inclined surface 3311, and the second inclined surface 3311 faces the switch control lock 32. When the position-limiting block 321 is in the first position-limiting recess, the support portion 10 and the bearing portion 20 are in a closed state; as shown in FIG. 4 and FIG. 5, on this occasion the first inclined surface 3211 and the second inclined surface 3311 are attached together.

If the support portion 10 and the bearing portion 20 are forcefully pulled apart, both of the support connection base 33 and the bearing connection base 36 are subjected to relative rotating pulling force, and the pulling force is transmitted to the first inclined surface 3211 from the second inclined surface 3311. The first inclined surface 3211 and the second inclined surface 3311 will slide relative to each other, such that the switch control lock 32 compresses the spring 31 and moves toward the direction of the bearing connection base 36 until the position-limiting block 321 of the switch control lock 32 is detached from the first position-limiting recess. Both of the support connection base 33 and the bearing connection base 36 begin rotating relative to each other until rotating to the position where the position-limiting block 321 corresponds to the second position-limiting recess. The spring 31 springs the position-limiting block 321 into the second position-limiting recess, which turns into the state that the position-limiting block 321 is stuck by the second position-limiting recess, and the support portion 10 and the bearing portion 20 are in an open state with a certain angle.

Accordingly, there is no need to press the button member 35 to change the support portion 10 and the bearing portion 20 from the closed state into the open state, it requires directly pulling open only, so the operation is convenient. When carrying the baby, the hipseat can be opened just in time.

The support portion 10 and the bearing portion 20 of the hipseat are covered in a cover 52. The cover 52 is formed into a seat surface so the baby can sit thereon, which provides sufficient a support area and support force for the baby.

At least one end portion 53 of the cover 52 is provided with a velcro tape or zipper 54 for connection, such that the bearing portion 20 is sleeved in the end portion 53. The other end portion 55 is a sleeve with one end being open, such that the support portion 10 is sleeved in the end portion 55. The two end portions are connected through an elastic material such as an elastic strap 56 so as to have elasticity and spreadability.

The surface material covering the end portion 55 of the support portion 10 has a cushion therein to form a structure with certain hardness for the baby to sit thereon.

The various embodiments in the present specification are described in a progressive manner, and each embodiment focuses on differences from other embodiments, and the same or similar parts between the various embodiments may be referred to each other. The above description of the disclosed embodiments makes it possible for those skilled in the art to implement or use the disclosure. Various modifications to these embodiments are obvious to those skilled in the art, and the general principles defined herein may be implemented in other embodiments without departing from the scope of the disclosure. Therefore, the present disclosure is not intended to be limited to the embodiments shown herein, but to be consistent to the broadest scope coherent with the principle and novel characteristics disclosed in the disclosure.

What is claimed is:

1. A foldable baby carrier, comprising a seat cushion connected to a carrier body, the seat cushion comprising a hipseat detachably disposed on the carrier body and a cover sleeved on the hipseat, the hipseat comprising a support portion and a bearing portion, the support portion and the bearing portion rotatably connected and formed into a foldable body through a left switch button and a right switch button disposed on two sides of the support portion; wherein a support connection base is fixed on the support portion, a bearing connection base is fixed on the bearing portion;

each of the left switch button and the right switch button comprising a connection shaft, the connection shaft sequentially passing through the support connection base, a switch control lock and a spring and then fixed on the bearing connection base;

the spring abutted against the switch control lock and the bearing connection base;

each of the left switch button and the right switch button further comprising a button member, the button member movably engaged with the support connection base, the button member pressing on a surface of the switch control lock;

an outer wall of the switch control lock provided with a position-limiting block, an inner wall of the support connection base provided with a first position-limiting recess and a second position-limiting recess corresponding to each of the position-limiting block;

wherein when the position-limiting block is in the second position-limiting recess, the position-limiting block is stuck by the second position-limiting recess, and the support portion and the bearing portion are in an open state;

wherein the position-limiting block has a first inclined surface, the first inclined surface faces the bearing connection base; a wall of the first position-limiting recess has a second inclined surface, the second inclined surface faces the switch control lock; when the position-limiting block is in the first position-limiting recess, the first inclined surface on the position-limiting block and the second inclined surface on the first position-limiting recess are attached together, and the support portion and the bearing portion are in a closed state.

2. The foldable baby carrier according to claim 1, wherein an outer wall of the switch control lock is provided with a plurality of engaging slots, correspondingly, a plurality of engaging blocks are provided in the bearing connection base, the engaging blocks are inserted into the engaging slots, such that the switch control lock can be elastically moved horizontally and inserted on the bearing connection base.

3. The foldable baby carrier according to claim 1, wherein at least one end portion of the cover adopts a velcro tape or a zipper for connection, and the other end portion is a sleeve with one end being open, the at least one end portion and the other end portion are respectively sleeved on the support portion and the bearing portion of the hipseat.

4. The foldable baby carrier according to claim 3, wherein the at least one end portion and the other end portion are connected through an elastic material.

* * * * *